US006303195B1

(12) United States Patent
Reynolds et al.

(10) Patent No.: US 6,303,195 B1
(45) Date of Patent: Oct. 16, 2001

(54) ORNAMENTAL SUPPORT

(76) Inventors: John T. Reynolds, 74 Edmund St., E. Longmeadow, MA (US) 01128; Peter L. Gamelli, Jr., 82 Oak St., Ludlow, MA (US) 01056

( * ) Notice: Subject to any disclaimer, the term of this patent is extended or adjusted under 35 U.S.C. 154(b) by 0 days.

(21) Appl. No.: 09/697,945

(22) Filed: Oct. 30, 2000

(51) Int. Cl.[7] ..... A47G 1/12

(52) U.S. Cl. ..... 428/13; 248/207; 248/215; 248/220.21; 248/235; 248/250; 248/304

(58) Field of Search ..... 428/7, 16, 28, 428/13, 542.2; 248/215, 235, 304, 305, 339, 340, 251, 220.21, 250, 207, 309.1

(56) References Cited

U.S. PATENT DOCUMENTS

D. 201,502 6/1965 Niemen .
D. 289,494 4/1987 Rice .
D. 365,748 1/1996 Hollinger .
D. 371,507 7/1996 Hollinger .
D. 419,429 1/2000 Emmett .
4,071,216 * 1/1978 Einhorn ..... 248/290
5,487,925 1/1996 Simmel et al. .

* cited by examiner

*Primary Examiner*—Deborah Jones
*Assistant Examiner*—Abraham Bahta
(74) *Attorney, Agent, or Firm*—Ross, Ross & Flavin

(57) ABSTRACT

Ornamental supports for supporting various items such as shelves, hanging plants, curtain rods, decorative fixtures, flag poles, name plaques, or the like and so constructed that ornamentation associated therewith may be easily be removed and replaced with other ornamentation thereby permitting the substitution of different ornamentation appropriate for differing tastes, different holidays, and different seasons of the year.

8 Claims, 10 Drawing Sheets

ORNAMENTAL SUPPORT

BACKGROUND OF THE INVENTION

1. Field of the Invention

The present invention relates to devices for securement to conventional support surfaces for supporting various items such as shelves, hanging plants, curtain rods, decorative fixtures, flag poles, name plaques, or the like.

2. Description of Prior Art

A wide variety of such supports is found in the prior art. However, they are deficient in that most are more utilitarian than decorative and, if they do include any decorative features, such features are a permanent part thereof and may not be varied.

SUMMARY OF THE INVENTION

Accordingly, it is an object of the present invention to provide ornamental supports for securement to conventional support surfaces and so constructed that ornamentation integral therewith may easily be removed and replaced with other ornamentation.

With the present invention, the supports can perform not only utilitarian functions but ornamental functions as well, which may be varied as desired to provide different ornamentation appropriate for differing tastes, different holidays, and different seasons of the year.

DESCRIPTION OF THE PREFERRED EMBODIMENTS

Figure 2:
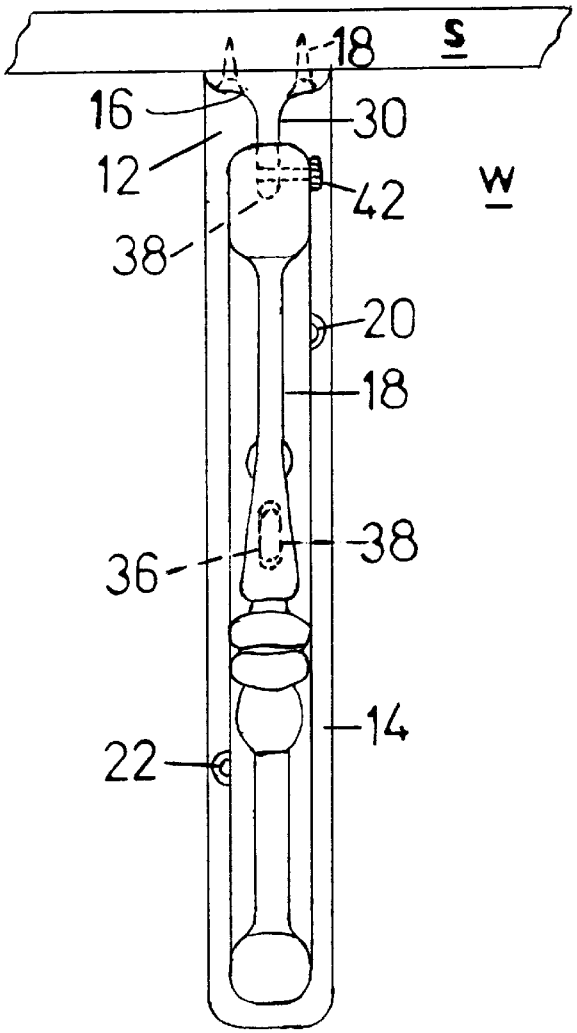
FIG. 2 is a front elevational view of the support of FIG. 1 as seen from the right.

Referring to FIGS. 1–8 an ornamental support embodying a first form of the invention is generally indicated by 10 and includes an inverted L-shaped, or right angle bracket 12 which comprises a vertically oriented arm 14 and a horizontally oriented arm 16 with ornamentation 18 removably fixed thereto.

A spaced pair of such ornamental supports 10 underlie a horizontal shelf 5 fixed to a support surface such as a wall W, with brackets 12 of the supports being fixed to wall W by screws 20 which extend through provided vertically spaced openings 22 in vertically disposed arms 14 and being fixed to shelf S by screws 24 which extend through provided spaced openings 26 in horizontally-disposed arms 16.

Brackets 12 and ornamentation 18 may be fabricated from metal, wood, plastic or other material as desired.

On brackets 12, a nose-like projection 28 is disposed approximately centrally of the length of vertically-disposed arm 14 and extends horizontally outwardly there from, while a nose-like projection 30 is disposed adjacent the free end of horizontally-disposed arm 16 and depends vertically there from, projection 30 having a threaded opening 31 therein, all for purposes to appear.

Figure 5:
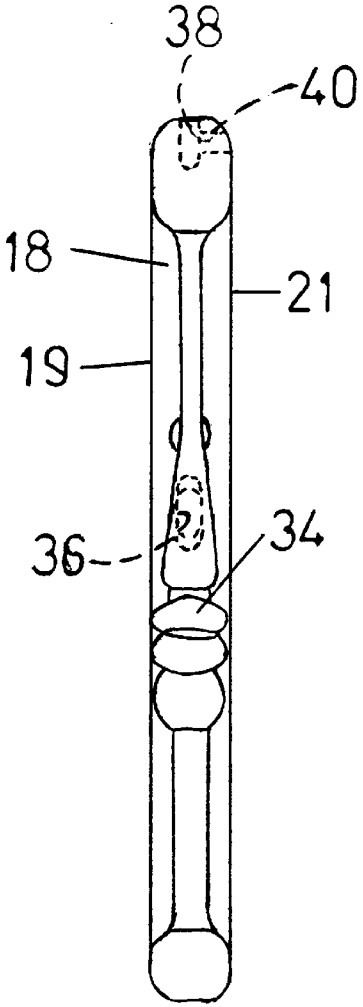
FIG. 5 is a front elevational view of the ornamentation of the support of FIG. 1.
Figure 4:
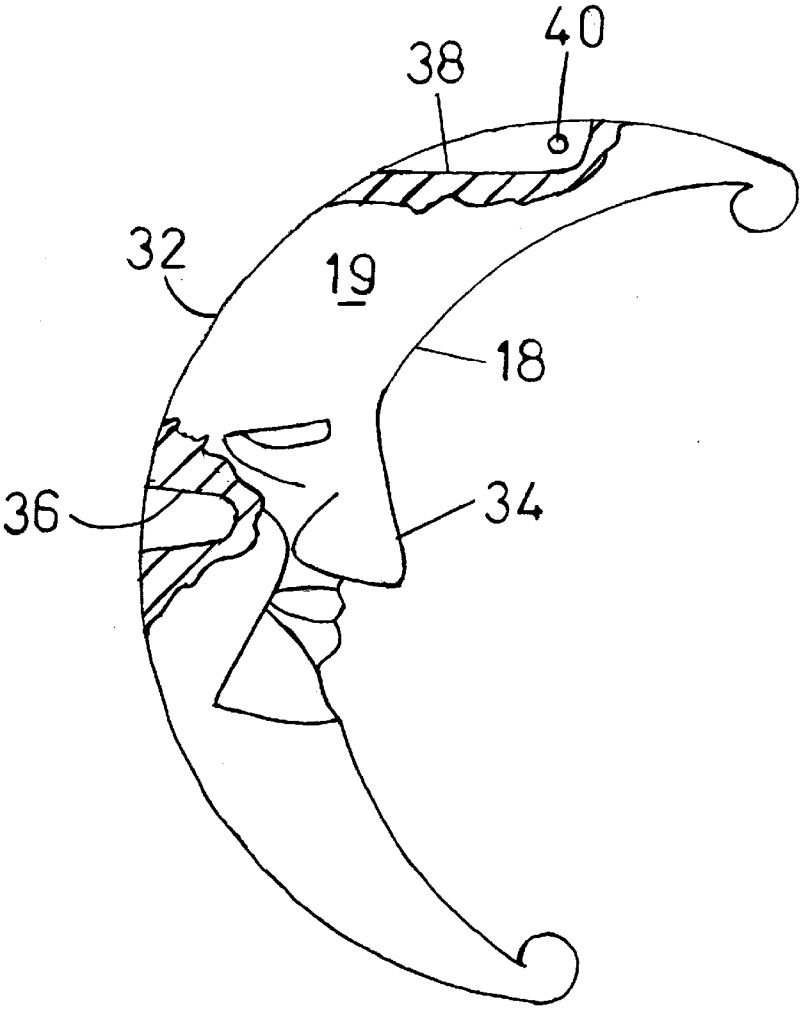
FIG. 4 is a side elevational view of the ornamentation of the support of FIG. 1 with parts broken away for clarity of illustration.
Figure 3:
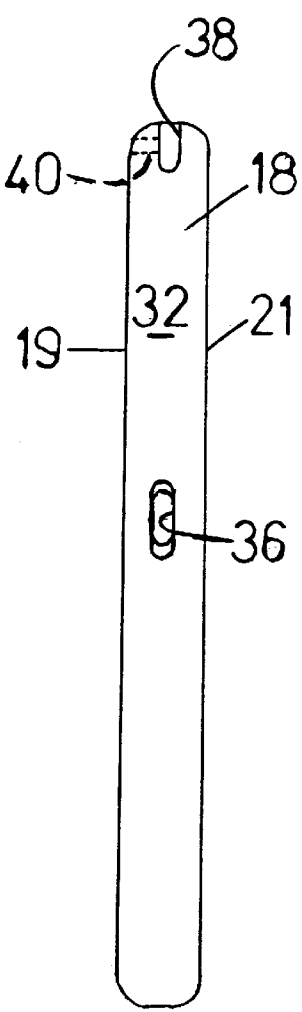
FIG. 3 is a rear elevational view of the ornamentation of the support of FIG. 1.
Figure 6:
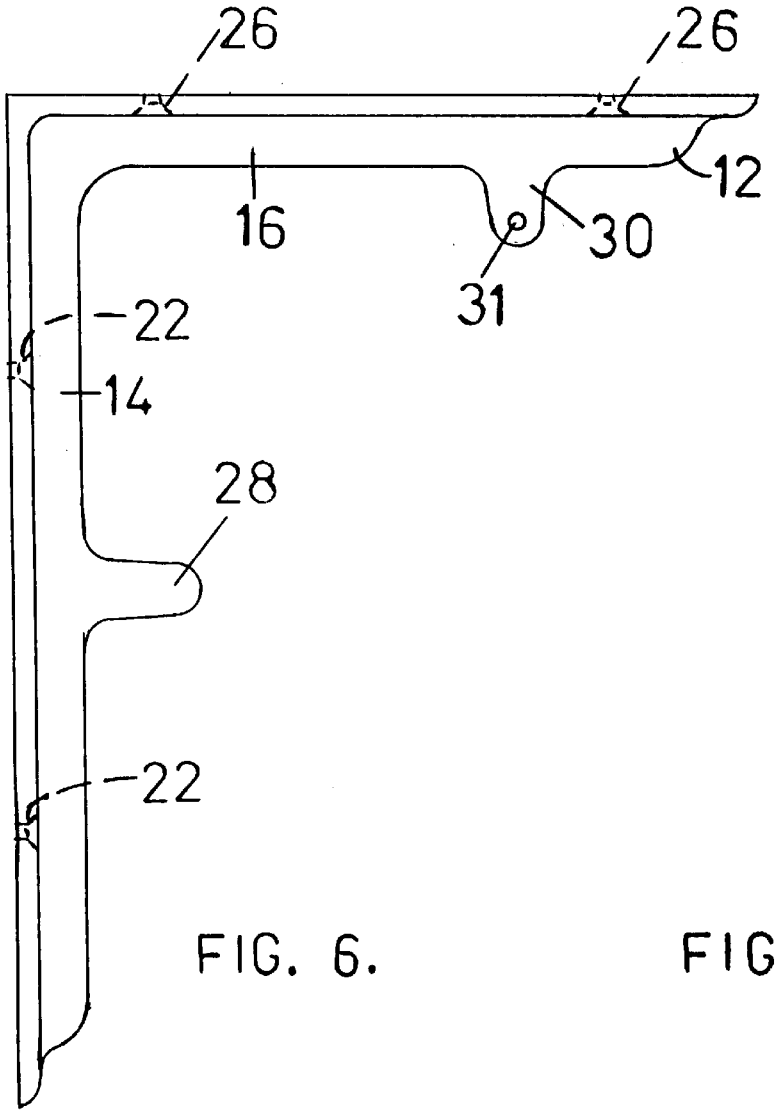
FIG. 6 is a side elevational view of the shelf bracket of the support of FIG. 1.
Figure 7:
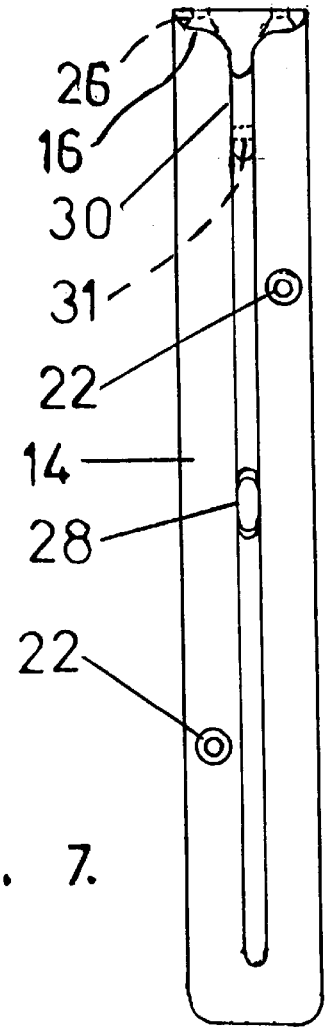
FIG. 7 is a front elevational view of the shelf bracket of the support of FIG. 1, as seen from the right.
Figure 8:
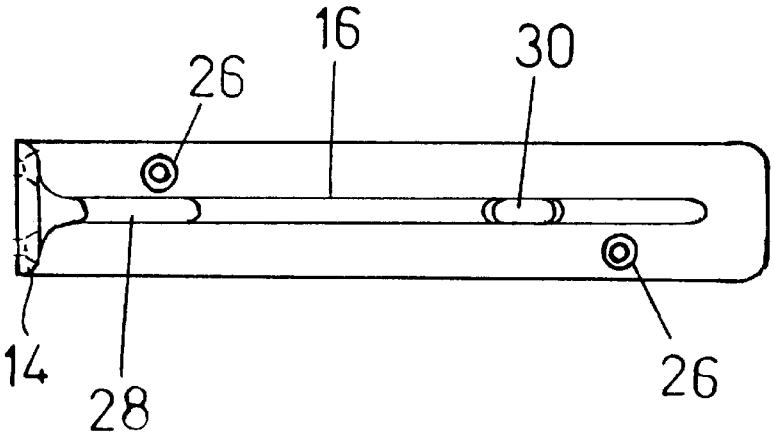
FIG. 8 is a bottom plan view of the shelf bracket of the support of FIG. 1.

Ornamentation 18, best seen in FIGS. 3–5, has spaced, parallel, planar faces 19 and 21, is crescent shaped in plan, and has the configuration of a quarter moon with a curved, outwardly-facing convex outer face 32 and a curved, inwardly-facing concave inner face 34 in the fanciful shape of a "man in the moon".

Curved outer face 32 of ornamentation 18 is provided approximately centrally of its length with an inwardly-extending, vertically-oriented slot 36 complemental in shape to projection 28 on vertical arm 14 of bracket 12, and is provided, adjacent its upper end, with an inwardly-extending, horizontally-oriented slot 38, complemental in shape to projection 30 on horizontal arm 16 of bracket 12, all for purposes to appear.

A through opening 40 extends transversely through ornamentation 18 across slot 38 adjacent the inner end of the slot.

Figure 1:
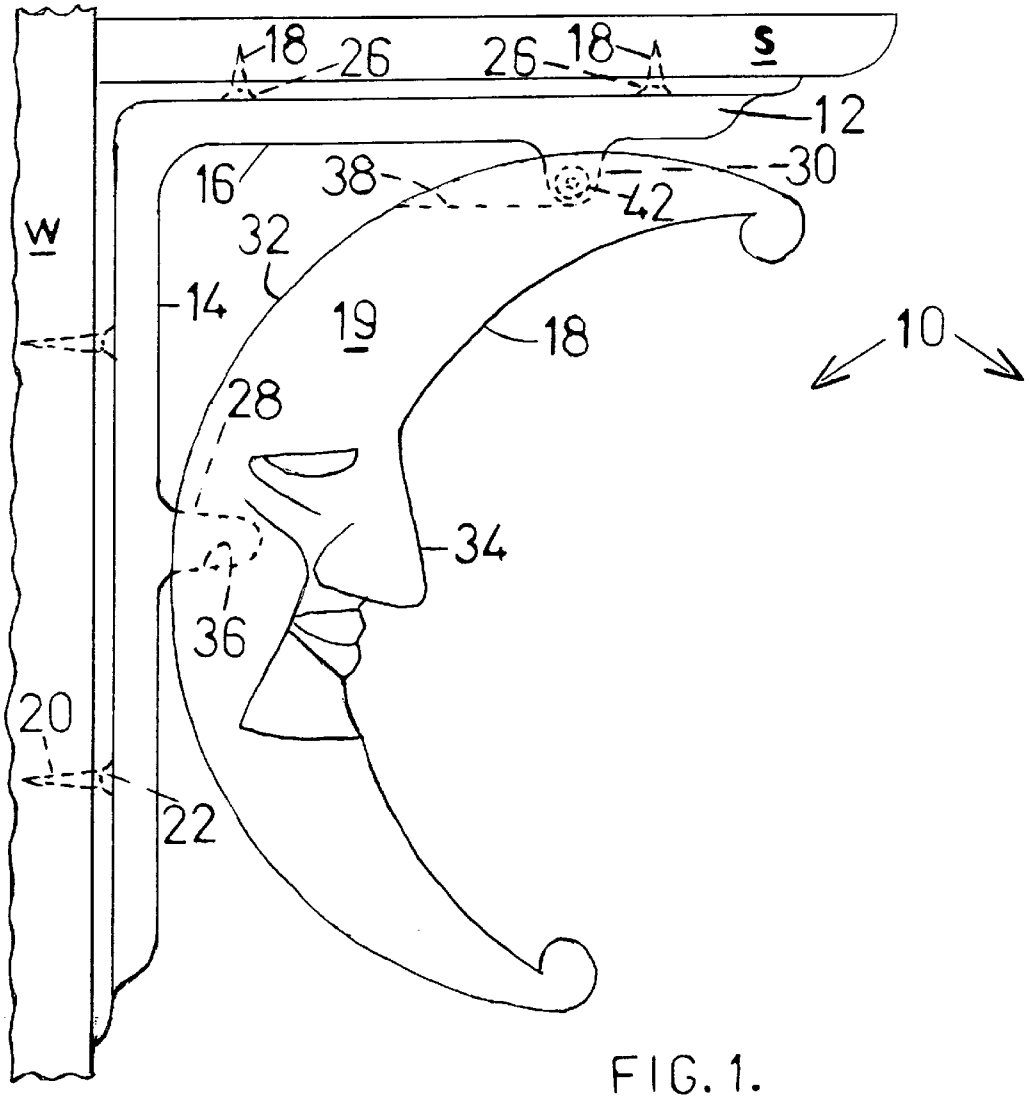
FIG. 1 is a side elevational view of a first form of support embodying the invention comprising a shelf bracket which has one form of ornamentation removably fixed thereto.

To assemble ornamentation 18 onto angle bracket 12, the ornamentation is positioned between arms 14 and 16 of the angle bracket so that projections 28 and 30 of the angle bracket are aligned with the slots 36 and 38 respectively of the ornamentation and the ornamentation is moved to the left as viewed in FIG. 1 so that the projections are disposed within the slots. At that time, the through opening 40 of ornamentation 18 is aligned with threaded opening 31 of projection 30. A thumbscrew 42 may now be inserted in opening 40 of the ornamentation and threaded into opening 31 of projection 30 to releasably secure ornamentation 18 to bracket 12.

It is an easy matter to change the ornamentation associated with the supports.

Simply remove the thumbscrew 42, slidably remove the ornamentation from projections 28 and 30 of bracket 12, and replace the ornamentation with other ornamentation.

Figure 10:
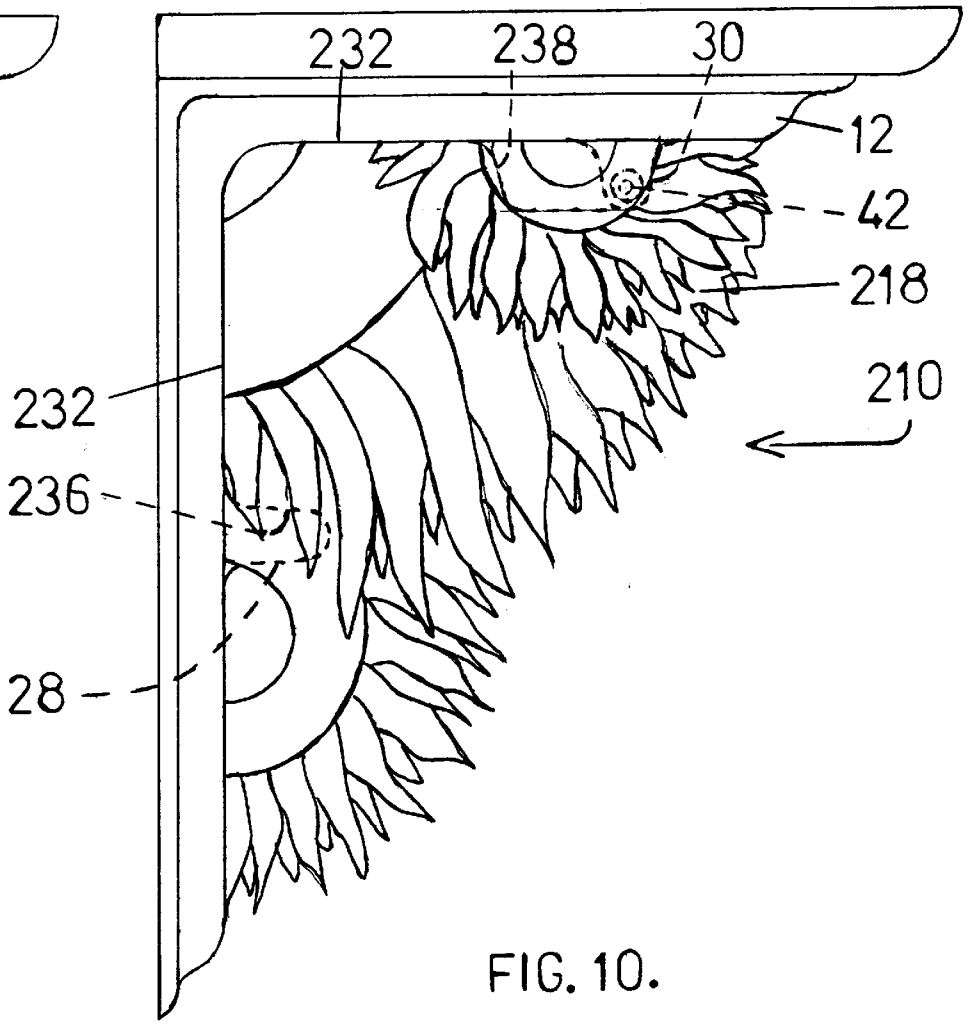
FIG. 10 is a side elevational view of a support having still another form of ornamentation removably fixed thereto.
Figure 9:
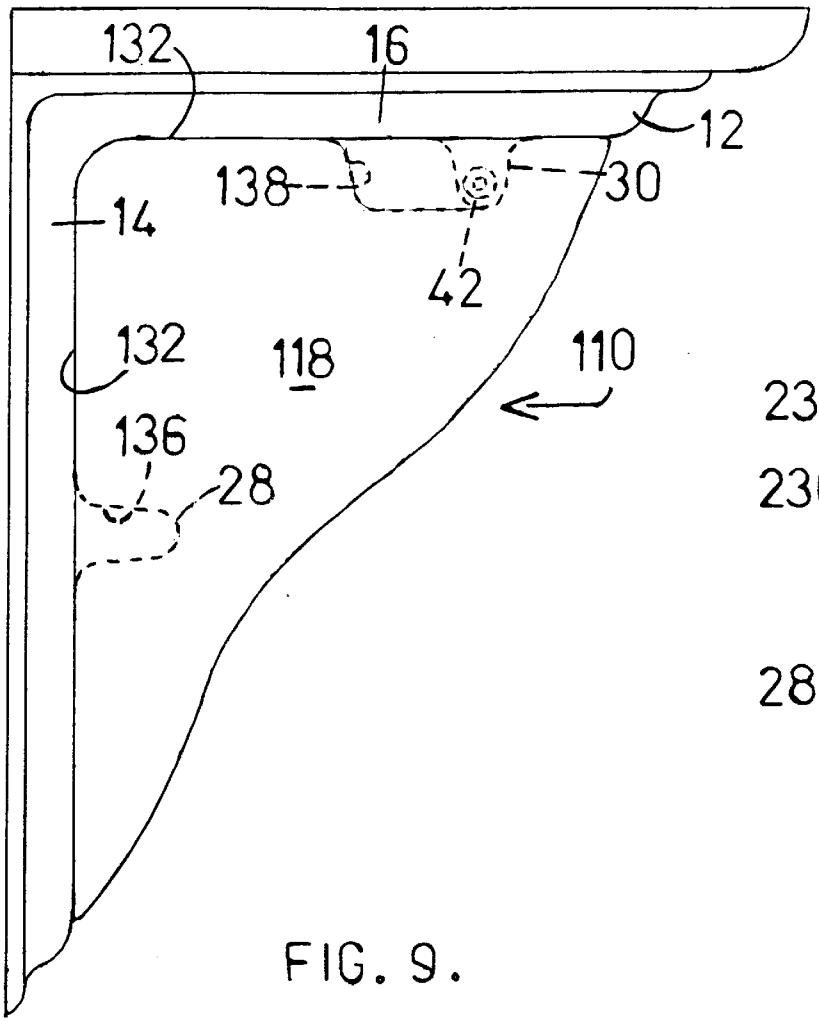
FIG. 9 is a side elevational view of a support having a second form of ornamentation removably fixed thereto.

In FIGS. 9 and 10, supports 110 and 210 incorporating modified ornamentations 118 and 218 respectively are shown as associated with shelf brackets 12 which are identical to those in FIGS. 1–8, each ornamentation having flat outer and upper faces rather than the convex outer and upper face 32 of ornamentation 18 of FIGS. 1–8.

In FIG. 9, ornamentation 118 has spaced, parallel, planar faces in plan, a flat, vertical outer face 132 and a flat, horizontal upper face 132'. Vertical outer face 132 has a vertically disposed slot 136 therein which extends inwardly therefrom. Horizontal outer face 132' has a horizontally disposed slot 138 therein which extends inwardly therefrom.

A through opening 140 extends transversely through ornamentation 118 across slot 138 adjacent the inner end of the slot.

Vertical slot 136 of face 132 of ornamentation 118 is appropriately positioned and configured as to accept projection 28 of shelf bracket 12 when face 132 is brought into confronting relationship with vertical arm 14 of the shelf bracket.

Horizontal slot 138 of face 132' of ornamentation 118 is appropriately positioned and configured as to accept projection 30 of shelf bracket 12 when face 132' is brought into confronting relationship with horizontal arm 16 of the shelf bracket.

At this time, through opening 140 of ornamentation 118 is aligned with threaded opening 31 of projection 30. Thumbscrew 42 may now be inserted in through opening 140 of the ornamentation and threaded into opening 31 of projection 30 to releasably secure ornamentation 118 to bracket 12.

In FIG. 10, ornamentation 218 has spaced, parallel, planar faces in plan, a flat, vertical outer face 232 and a flat, horizontal upper face 232'. Vertical outer face 232 has a vertically disposed slot 236 therein which extends inwardly therefrom. Horizontal outer face 232' has a horizontally disposed slot 138 therein which extends inwardly therefrom.

A through opening 240 extends transversely through ornamentation 218 across slot 238 adjacent the inner end of the slot.

Vertical slot 236 of face 232 of ornamentation 218 is appropriately positioned and configured as to accept projection 28 of shelf bracket 12 when face 232 is brought into confronting relationship with vertical arm 14 of the shelf bracket.

Horizontal slot 238 of face 232' of ornamentation 218 is appropriately positioned and configured as to accept projection 30 of shelf bracket 12 when face 232' is brought into confronting relationship with horizontal arm 16 of the shelf bracket.

At this time, through opening 240 of ornamentation 218 is aligned with threaded opening 31 of projection 30. Thumbscrew 42 may now be inserted in opening 240 of the ornamentation and threaded into opening 31 of projection 30 to releasably secure ornamentation 218 to bracket 12.

Figure 12:
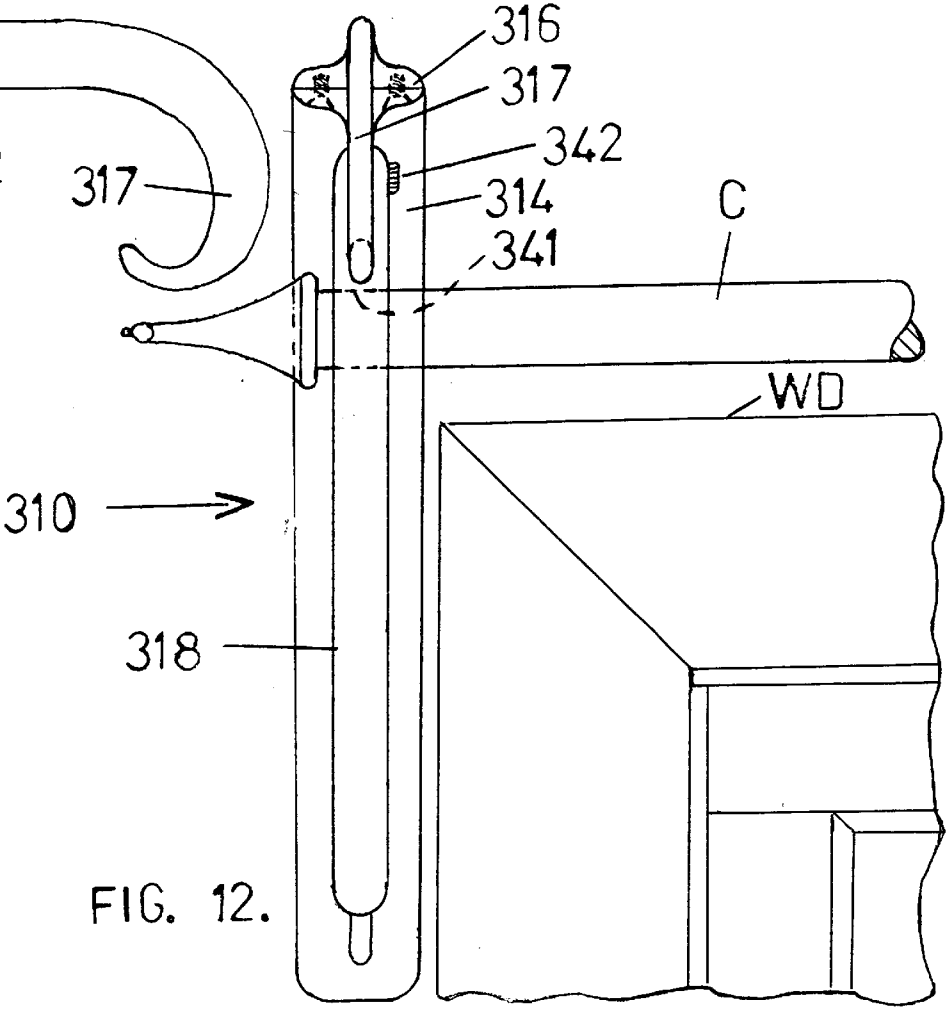
FIG. 12 is a front elevational view of the support of FIG. 11 associated with a window.
Figure 11:
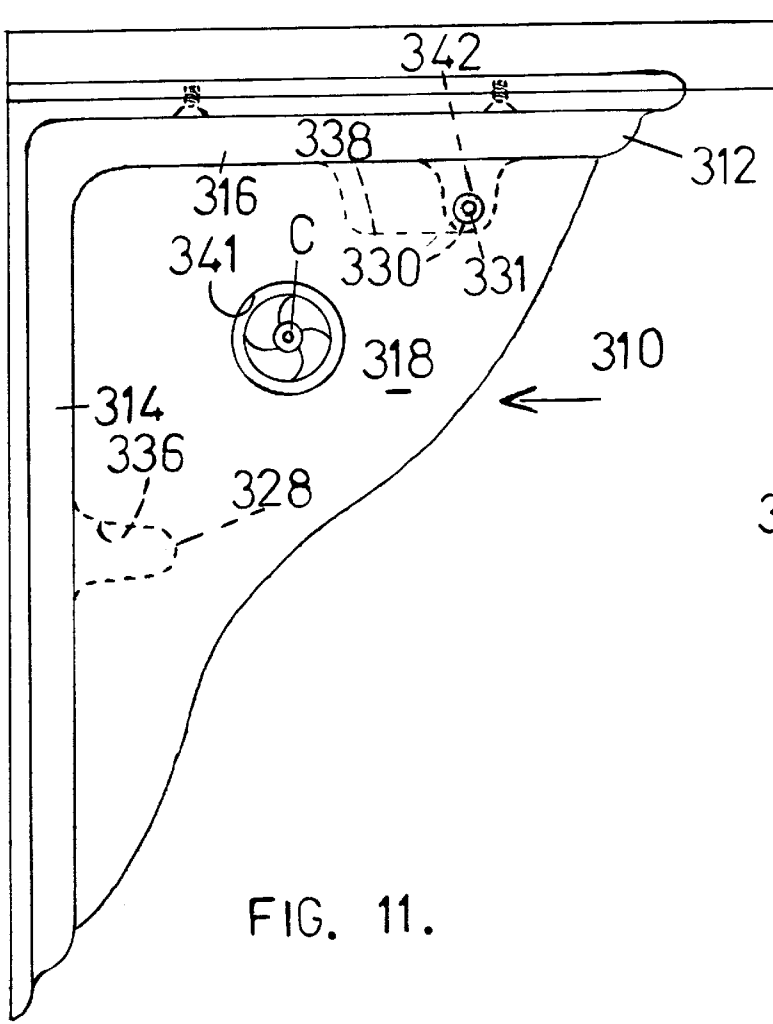
FIG. 11 is a side elevational view of a second form of support embodying the invention comprising a plant hanger bracket with ornamentation removably fixed thereto, the ornamentation also serving as a curtain rod support.

Referring to FIGS. 11 and 12, an ornamental support embodying a further modified form of the invention is generally indicated by 310 and includes an inverted substantially L-shaped, or right angle plant hanger bracket 312 which replaces shelf bracket 12 of FIGS. 1–10, and has a modified ornamentation 318 associated therewith.

Modified ornamentation 318 is identical to ornamentation 118 of FIG. 9 except that the body of ornamentation 318 has a circular through opening 341 disposed approximately centrally thereof, which opening may also serve to allow the passage of a cylindrical curtain rod C therethrough to provide support for the ends of the curtain rod disposed above a window W.

Plant hanger bracket 312 includes a vertically oriented arm 314 and a horizontally oriented arm 316 which has a plant hanging hook 317 formed integrally therewith and extending horizontally outwardly and downwardly therefrom.

Support 310 may be fixed to any suitable surface such as a wall as by screws or the like which extend through provided spaced openings in vertical arm 314, all not shown.

Bracket 312 and ornamentation 318 may be fabricated from metal, wood, plastic or other material as desired.

Bracket 312 is similar to bracket 12 of FIGS. 1–10. A nose-like projection 328 is disposed approximately centrally of the length of vertically disposed arm 314 and extends horizontally outwardly therefrom, while a nose-like projection 330 is disposed adjacent the outer end of horizontally-disposed arm 316 and depends vertically therefrom, projection 330 having a threaded opening 331 therein.

Ornamentation 318 may be removably fixed to arms 314 and 316 of the plant hanger bracket in a manner as previously described, with the ornamentation being releasably fixed to the plant bracket by inserting a thumb screw 342 into opening 340 of the ornamentation and threading it into opening 331 of projection 330 of bracket 312.

Figure 14:
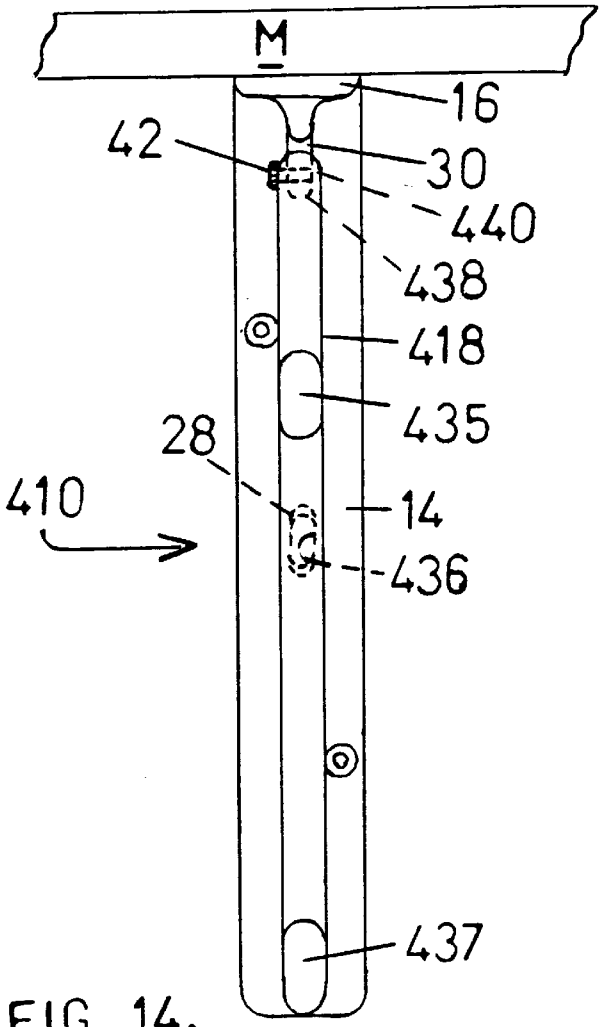
FIG. 14 is a front elevational view of the support of FIG. 13.
Figure 13:
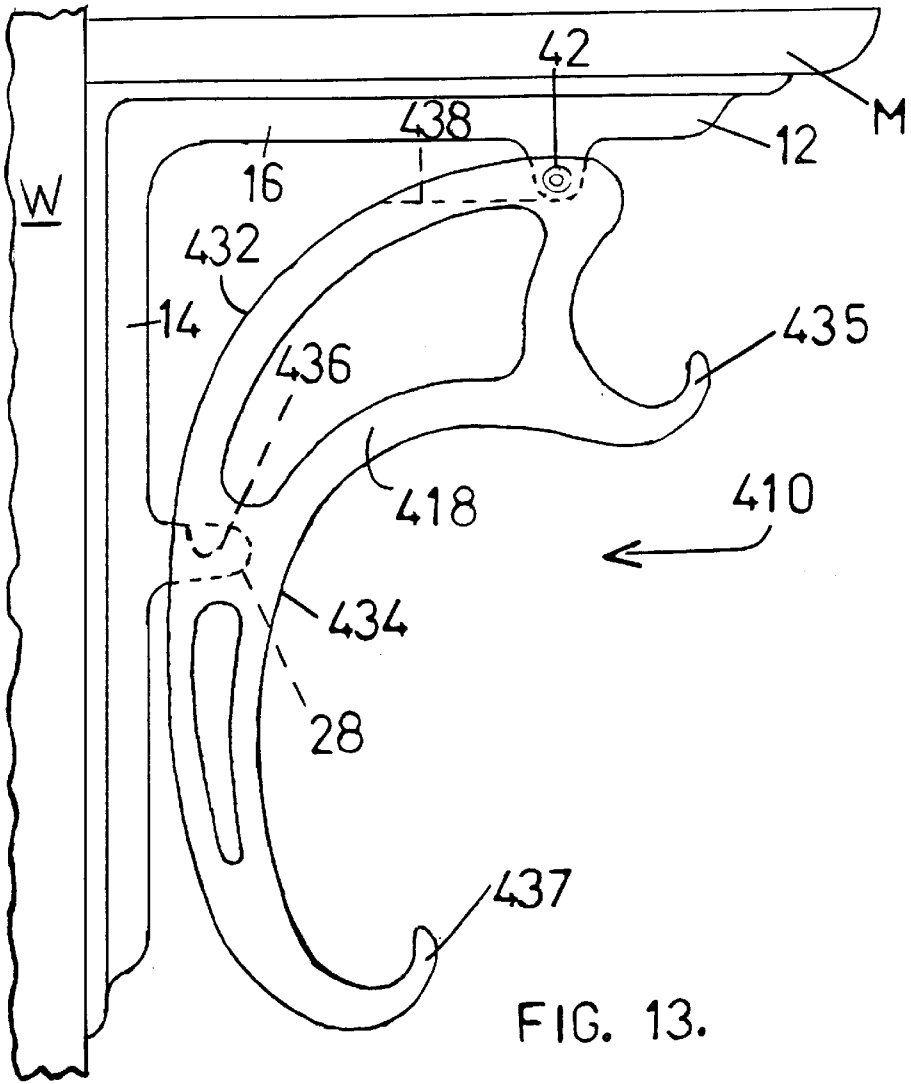
FIG. 13 is a side elevational view of a third form of support embodying the invention comprising an ornamental hanger for fireplace tools removably fixed to a bracket which is in turn fixed to both a wall and fireplace mantel.

In FIGS. 13 and 14, a support 410 incorporates a modified ornamentation 418 associated with a bracket 12 which is identical to the brackets of FIGS. 1–10, the support being suspended from a mantel M and attached to wall W.

Ornamentation 418 has a part elliptical configuration with spaced, parallel, planar faces, a curved outwardly-facing convex outer face 432 and a curved, inwardly-facing concave inner face 434.

Ornamentation 418, incorporates at its upper end a first integral upwardly-facing hook 435, and incorporates at its lower end a second integral upwardly-facing hook 437, the hooks being adaptable for hanging fireplace tools such as pokers or the like, or for hanging clothing.

Curved outer face 432 of ornamentation 418 is provided approximately centrally of its length with an inwardly-extending, vertically-oriented slot 436 complemental in shape to projection 28 on vertical arm 14 of bracket 12, and is provided, adjacent its upper end, with an inwardly-extending, horizontally-oriented slot 438, complemental in shape to projection 30 on horizontal arm 16 of bracket 12.

A through opening 440 extends transversely through ornamentation 418 across slot 438 adjacent the inner end of the slot.

To assemble ornamentation 418 onto bracket 12, the ornamentation is positioned between arms 14 and 16 of the bracket so that projections 28 and 30 of the bracket are aligned with the slots 436 and 438 respectively of the ornamentation and the ornamentation is moved to the left as viewed in FIG. 13 so that the projections are disposed within the slots. At this time, the through opening 440 or ornamentation 418 is aligned with threaded opening 31 of projection 30. Thumbscrew 42 may now be inserted in opening 440 of the ornamentation and threaded into opening 31 of projection 30 to releasably secure ornamentation 418 to bracket 12.

Figure 16:
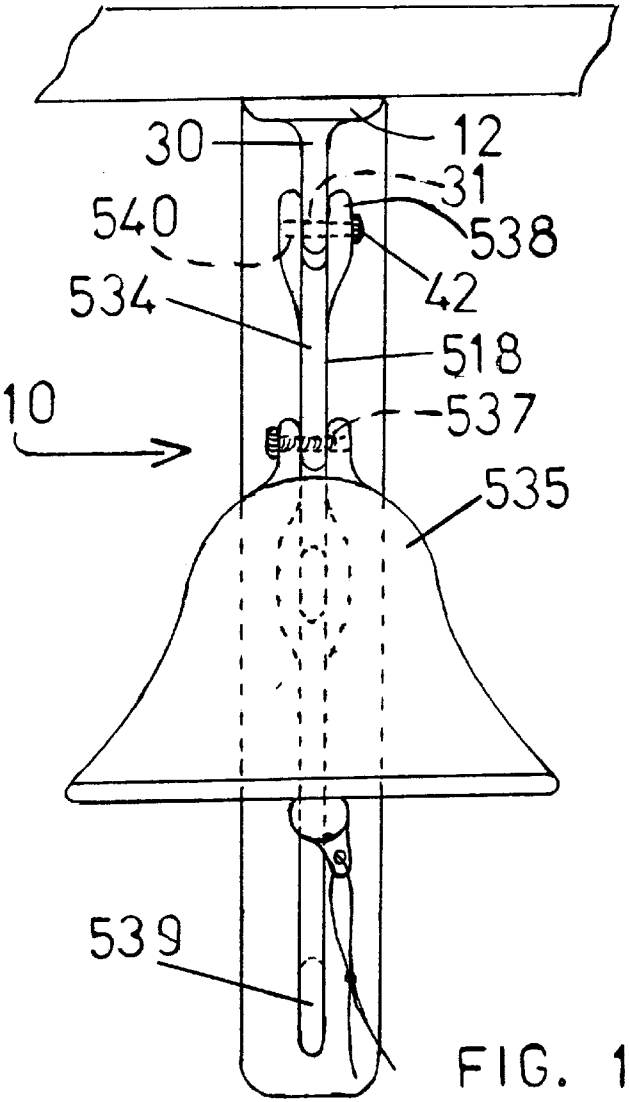
FIG. 16 is a front elevational view of the support of FIG. 15.
Figure 15:
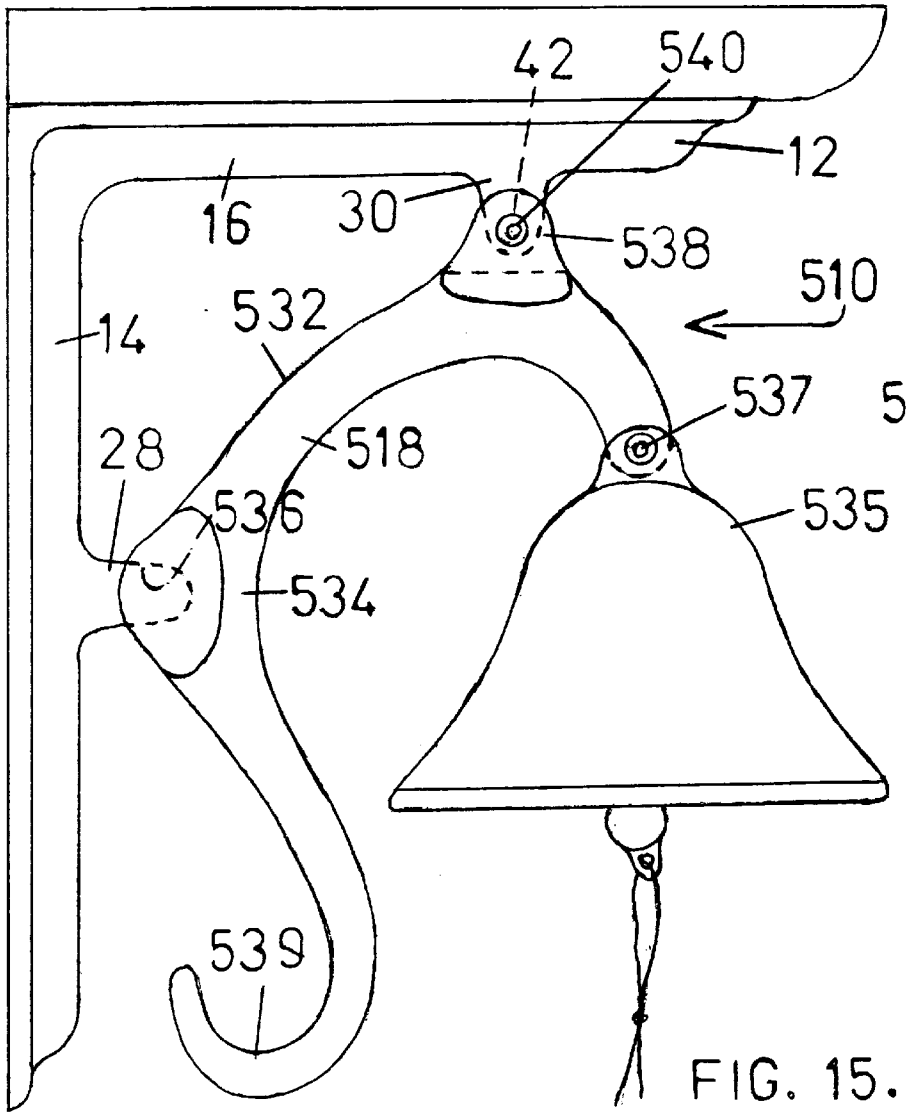
FIG. 15 is a side elevational view of a further form of support embodying the invention comprising a bracket with an ornamental lamp fixture or ornamental bell removably fixed thereto.

In FIGS. 15 and 16, a support 510 incorporates a modified ornamentation 518 associated with a bracket 12, which is identical to the brackets of FIGS. 1–10 and 13.

Ornamentation 518 has a configuration somewhat resembling that of a sea horse with spaced, parallel, planar faces in plan, a curved, outwardly-facing convex outer face 532 and a curved, inwardly-facing concave inner face 534.

A bell ornament of lamp fixture 535 is pivoted to the upper end of ornamentation 518 by a pivot pin 537 and depends therefrom.

Ornamentation 518 incorporates at its lower end an integral upwardly facing hook 539 adaptable for hanging articles therefrom if desired.

Curved outer face 532 of ornamentation 518 is provided approximately centrally of its length with an inwardly-extending, vertically-oriented slot 536 complemental in shape to projection 28 on vertical arm 14 of bracket 12, and is provided, adjacent its upper end, with an upwardly-extending bifurcated projection 538 adapted for engagement with projection 30 on horizontal arm 16 of bracket 12.

A through opening 540 extends transversely through projection 538 of ornamentation 518.

To assemble ornamentation 518 onto bracket 12, the ornamentation is positioned between arms 14 and 16 of the bracket so that projections 28 and 30 of the bracket are aligned with the slot and projection 538 respectively of the ornamentation and the ornamentation is moved to the left as viewed in FIG. 15 so that projection 28 of the bracket is disposed in slot 536 of the ornamentation and projection 30 of the bracket is disposed within the bifurcation of projection 538 of the ornamentation.

At this time, the through opening 540 of ornamentation 518 is aligned with threaded opening 31 of projection 30. Thumbscrew 42 may now be inserted in opening 540 of the ornamentation and threaded into opening 31 of projection 30 to releasably secure ornamentation 518 to bracket 12.

Figure 18:
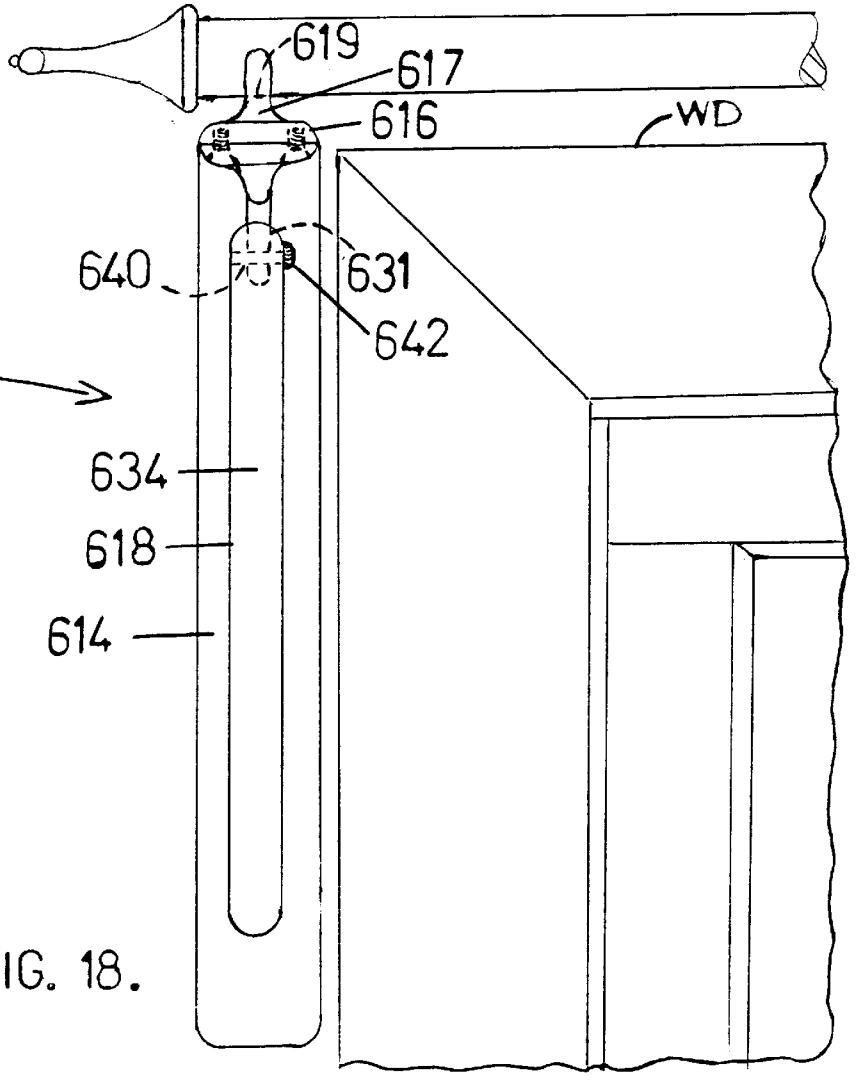
FIG. 18 is a front elevational view of the support of FIG. 17 associated with a window.
Figure 17:
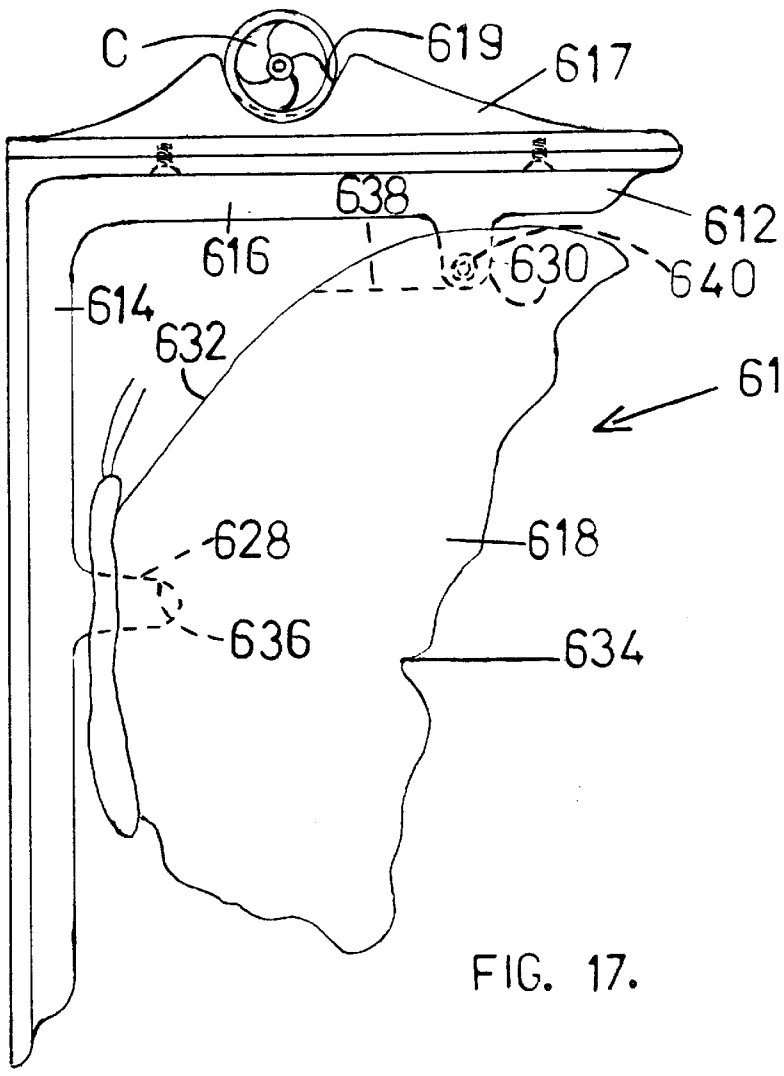
FIG. 17 is a side elevational view of a fifth form of support embodying the invention comprising a curtain rod bracket with ornamentation in the form of a butterfly removably fixed thereto.

Referring to FIGS. 17 and 18, an ornamental support embodying a further modified form of the invention is generally indicated by 610 and includes an inverted substantially L-shaped, or right angle curtain rod bracket 612 which replaces shelf bracket 12 of FIGS. 1–10, 13 and 15, the support incorporating a modified ornamentation 618 therein.

Curtain rod bracket 612 includes a vertically oriented arm 614 and a horizontally oriented arm 616 which has an integral raised surface 617 extending upwardly therefrom, the raised surface incorporating in its upper face approximately centrally of its length a semi-circular depression 619 of appropriate size to accommodate a cylindrical curtain rod C therein.

A spaced pair of such supports 610 may be fixed to the wall above a window WD to provide support at both ends of the curtain rod.

Bracket 612 is otherwise similar to bracket 12 of FIGS. 1–10, 13 and 15. A nose-like projection 628 is disposed approximately centrally of the length of vertically disposed arm 614 and extends horizontally outwardly therefrom, while a nose-like projection 630 is disposed adjacent the outer end of horizontally disposed arm 616 and depends vertically therefrom, projection 630 having a threaded opening 631 therein.

Ornamentation 618 has spaced, parallel, planar faces in plan and is configured in the fanciful shape of a butterfly with a curved, convex outer face 632 and an irregular, angled inner face 634.

Curved outer face 632 of ornamentation 618 is provided approximately centrally of its length with an inwardly-extending, vertically-oriented slot 636 complemental in shape to projection 628 on vertical arm 614 of bracket 612, and is provided, adjacent its upper end, with an inwardly-extending, horizontally-oriented slot 638, complemental in shape to projection 630 on horizontal arm 616 of bracket 612.

A through opening 640 extends transversely through ornamentation 618 across slot 638 adjacent the inner end of the slot.

To assemble ornamentation 618 onto bracket 612, the ornamentation is positioned between arms 614 and 616 of the bracket so that projections 628 and 630 of the bracket are aligned with the slots 636 and 638 respectively of the ornamentation and the ornamentation is moved to the left as viewed in FIG. 17 so that the projections are disposed within the slots. At this time, the through opening 640 of ornamentation 618 is aligned with threaded opening 631 of projection 630. A thumbscrew 642 may now be inserted in opening 631 of projection 630 to releasably secure ornamentation 618 to bracket 612.

Figure 19:
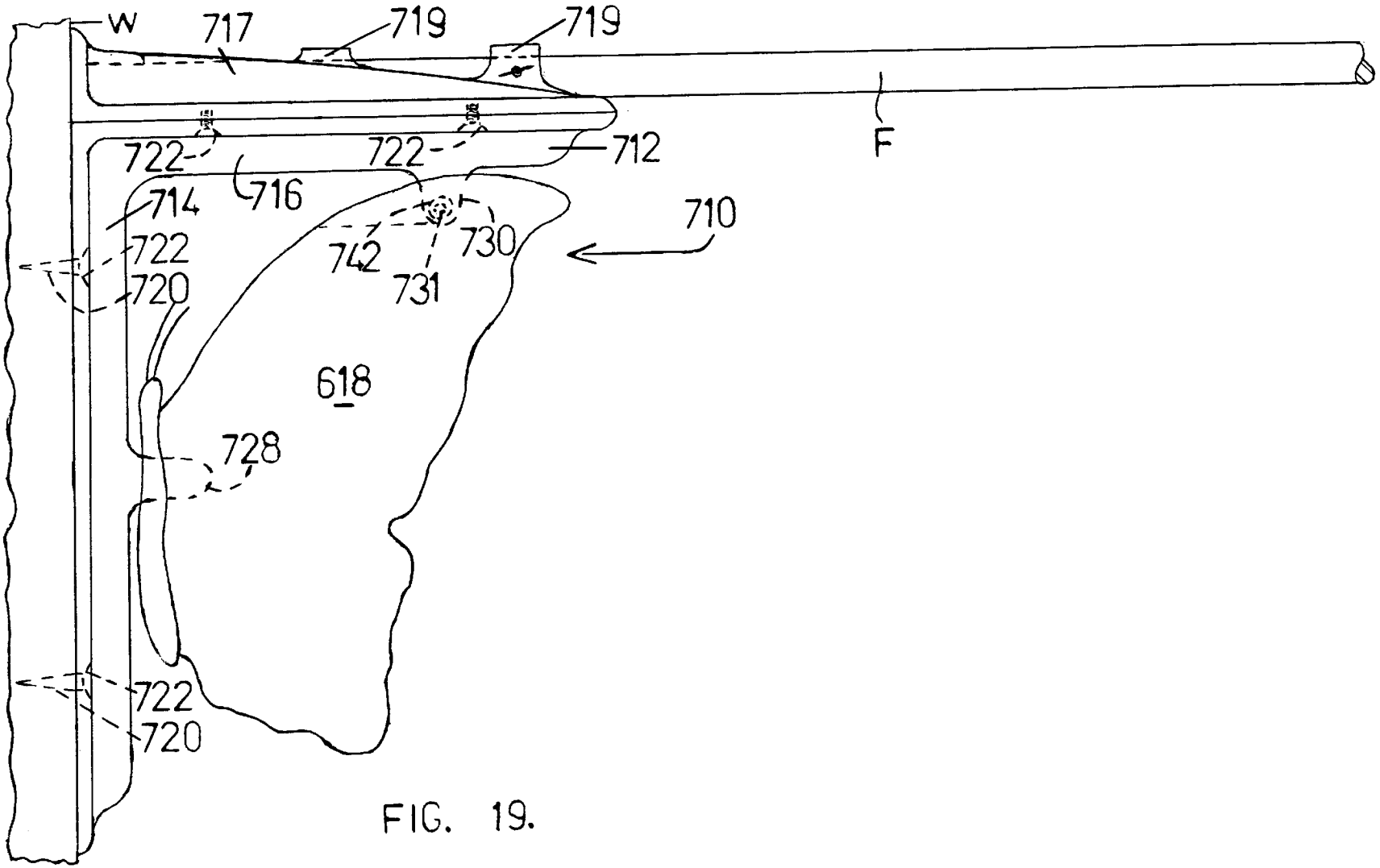
FIG. 19 is a side elevational view of a further form of support embodying the invention comprising a flag pole bracket with ornamentation in the form of a butterfly removably fixed thereto.

Referring to FIG. 19, an ornamental support embodying a further modified form of the invention is generally indicated by 710 and includes an inverted substantially L-shaped, or right angle flag pole bracket 712 which replaces shelf bracket 12 of FIGS. 1–10, 13 and 15, the support incorporating the butterfly ornamentation 618 of FIG. 17 therein.

Flag pole bracket 712 includes a vertically oriented arm 714 and a horizontally oriented arm 716 which has a bifurcated raised surface incorporating in its upper face a pair of spaced, semi-circular rings 719 of appropriate size to accommodate the end of a cylindrical flag pole F therein.

Flag pole bracket 712 may be fixed to wall W as by screws 720 which extend into the wall through provided opening 722 in arm 714 of the bracket.

Bracket 712 is otherwise similar to bracket 12 of FIGS. 1–10, 13 and 15. A nose-like projection 728 is disposed approximately centrally of the length of vertically disposed arm 714 and extends horizontally outwardly therefrom, while a nose-like projection 730 is disposed adjacent the outer end of horizontally-disposed arm 716 and depends vertically therefrom, projection 730 having a threaded opening 731 therein.

To assemble ornamentation 618 onto bracket 712, the ornamentation is positioned between arms 714 and 716 of the bracket so that projections 728 and 730 of the bracket are aligned with the slots 636 and 638 respectively of the ornamentation and the ornamentation is moved to the left as viewed in FIG. 19 so that the projections are disposed within the slots. At this time, the through opening 640 of ornamentation 618 is aligned with threaded opening 731 of projection 730. A thumbscrew 742 may now be inserted in opening 640 of the ornamentation and threaded into opening 731 of projection 730 to releasably secure ornamentation 618 to bracket 712.

Figure 20:
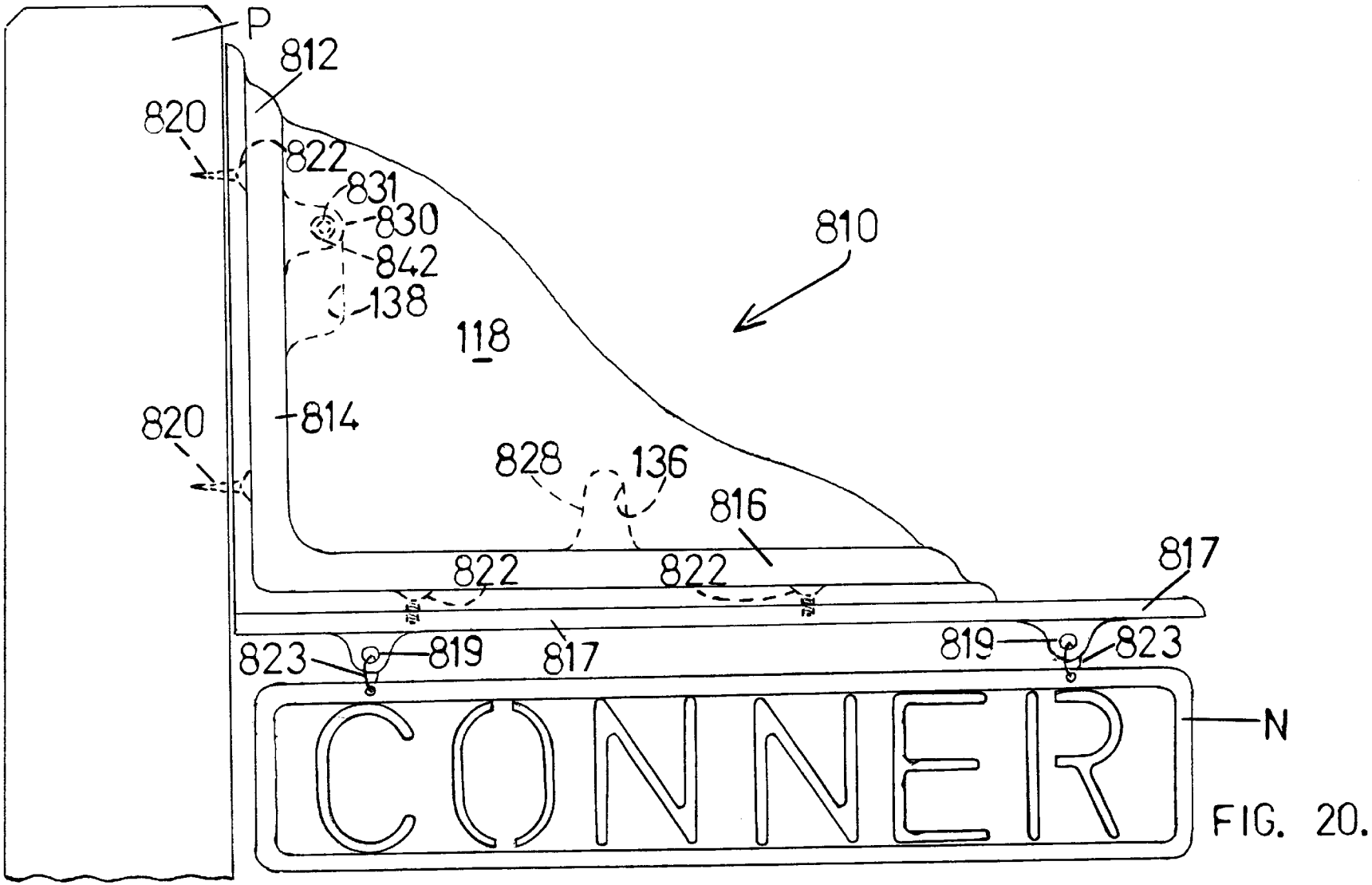
FIG. 20 is a side elevational view of a still further form of support embodying the invention comprising a name plaque bracket with ornamentation removably fixed thereto.

In FIG. 20 a further modified form of ornamental support is generally indicated by 810 and includes a substantially L-shaped, or right angle name plaque bracket 812 which replaces shelf bracket 12 of previous embodiments, the support incorporating ornamentation 118 of FIG. 9 therein.

Name plaque bracket 812 includes a vertically oriented arm 814 and a horizontally oriented arm 816 which has a plaque support bar 817 fixed to its lower face as by screws 822.

Plaque support bar 817 has a pair of integral, spaced, apertured projections 819 depending from its lower surface for receiving suspension clips 823 of a name plaque N.

Name plaque bracket 812 may be fixed to a fence post or lamp post P as by screws 820 which extend into the post through provided openings 822 in arm 814 of the bracket.

Bracket 812 includes a nose-like projection 828 disposed approximately centrally of the length of horizontally disposed arm 816 and extends horizontally upward therefrom, while a nose-like projection 830 is disposed adjacent the outer end of vertically disposed arm 814 and extends outwardly therefrom, projection 830 having a threaded opening 831 therein.

To assemble ornamentation 118 onto bracket 812 the ornamentation is positioned between arms 814 and 816 of the bracket so that projections 828 and 830 of the bracket are aligned with the slots 136 and 138 respectively of the ornamentation and the ornamentation is moved to the left as viewed in FIG. 20 so that the projections are disposed within the slots. At this time, the through opening of ornamentation 118 is aligned with threaded opening 831 of projection 830. A thumbscrew 842 may now be inserted in opening 840 of the ornamentation and threaded into opening 831 of projection 830 to releasably secure ornamentation 118 to bracket 812.

From the foregoing it should be apparent that the concepts of the invention can be applied in virtually any situation where articles are to be supported.

In addition to those situations already described, the concept of the invention may by applied to audio speaker mounts, security/surveillance camera mounts and even bathroom tissue roll dispenser mounts.

What is claimed is:

1. A device for securement to conventional support surfaces for supporting shelves, hanging plants, curtain rods, decorative fixtures, flag poles and name plaques comprising, an inverted L-shaped bracket having a pair of arms perpendicular to each other joined at one end and forming a right angle, one of the arms being attached to the support surface, ornamentation releasably affixed to the bracket, coupling means integral with the bracket and ornamentation comprising a projection on each bracket arm and a pair of spaced openings in the ornamentation, the projections on the bracket being receivable in the openings in the ornamentation so as to be substantially concealed from view when the ornamentation is brought into engagement with the bracket, and locking means selectively engageable with and disengageable from the coupling means, wherefore, when the locking means is engaged with the coupling means, removal of the ornamentation from the bracket is precluded and when the locking means is disengaged from the coupling means, removal of the ornamentation from the bracket is permitted.

2. In a device according to claim 1, wherein the locking means is a thumbscrew threadedly engageable in aligned openings in the ornamentation and in one of the projections on the bracket.

3. In a device according to claim 1, wherein the ornamentation is crescent shaped with a curved, outwardly-facing convex outer face and the spaced openings extend inwardly into the ornamentation from said outer face.

4. In a device according to claim 1, wherein the ornamentation has a right angle shaped outwardly facing outer face complemental to the shape of the bracket and the spaced openings extend inwardly into the ornamentation from said outer face.

5. In a device according to claim 1, wherein the bracket arm which is not attached to the support surface has an integral raised surface extending upwardly therefrom, the raised surface having an upper face incorporating a semi-circular depression therein for supporting an end of a cylindrical curtain rod.

6. In a device according to claim 1, wherein the ornamentation body is configured in the fanciful shape of a butterfly, the body having a circular through opening therein for allowing the passage of a cylindrical curtain rod therethrough for providing support for an end of the curtain rod.

7. In a device according to claim 1, wherein the bracket arm which is not attached to the support surface has a raised surface fixed thereto and extending upwardly therefrom, the raised surface having an upper face incorporating a pair of spaced, semi-circular rings for accommodating and supporting an end of a cylindrical flag pole.

8. In a device according to claim 1, Wherein the bracket arm which is not attached to the support surface has a support rod fixed thereto, the support rod incorporating means for suspending a name plaque therefrom.

* * * * *